United States Patent [19]

Nemeth et al.

[11] Patent Number: 4,568,855

[45] Date of Patent: Feb. 4, 1986

[54] SPARK PLUG

[75] Inventors: Joseph Nemeth, Harsens Island, Mich.; Clifford C. McMahon, Windsor, Canada; Daniel L. Tribble, Maumee, Ohio

[73] Assignee: Champion Spark Plug Company, Toledo, Ohio

[21] Appl. No.: 475,170

[22] Filed: Mar. 14, 1983

[51] Int. Cl.[4] ..... H01T 13/38

[52] U.S. Cl. ..... 315/59; 313/137; 313/134

[58] Field of Search ..... 313/137, 134, 138; 315/58, 59

[56] References Cited

U.S. PATENT DOCUMENTS

| | | | |
|---|---|---|---|
| 2,926,275 | 2/1960 | Péras | 313/137 X |
| 3,173,056 | 3/1965 | Dressel | 315/58 |
| 3,295,005 | 12/1966 | Poellet et al. | 313/137 |
| 3,546,369 | 12/1970 | Ouki et al. | 313/137 X |
| 4,439,707 | 3/1984 | Hattori et al. | 313/137 X |

*Primary Examiner*—Palmer C. DeMeo

*Attorney, Agent, or Firm*—John C. Purdue; David C. Purdue

[57] ABSTRACT

An improved spark plug, capable of suppressing radio-frequency electromagnetic interference from internal combustion engine ignition systems such as those commonly used in motor vehicles, is disclosed. The plug comprises a shell releasably engageable with an engine, an insulator mounted in the shell, a center electrode seated within the insulator and a ground electrode structurally integral with the shell and in spark gap relationship with the center electrode. The spark plug is further characterized in that at least a portion of its insulator has a dielectric constant sufficiently high that the effective dielectric constant of the insulator is at least 30, and the relationships among the elements of the spark plug and the effective value of the dielectric constant of the insulator are such that the spark plug has a capacitance of at least 20 picofarads. Preferably, the spark plug has a capacitance of from 20 to 100 picofarads, most desirably from 30 to 80 picofarads.

9 Claims, 5 Drawing Figures

SPARK PLUG

BACKGROUND OF THE INVENTION

1. Field of the Invention

This invention relates to a spark plug which is fired by the ignition system of an internal combustion engine, and more particularly to an improved spark plug which substantially reduces electromagnetic interference (EMI) that occurs during operation of such engines.

A typical induction ignition system of an internal combustion engine produces a rapid voltage rise in a secondary winding of an ignition coil which is electrically connected to a center electrode of a spark plug. If the voltage rise is great enough, a gap between the center electrode and a ground electrode will ionize and a spark discharge will occur therein. Absent some means of suppression in the ignition circuit, this initial spark discharge will be followed by relatively high frequency, oscillatory spark discharges. These discharges are the source of EMI which causes interference in electronic equipment which is sensitive to the frequency of the discharge and sufficiently close to the engine to receive the transmission which it causes.

EMI, especially that caused by internal combustion engines of automobiles, boats, aircraft, and the like, has been the focus of increased concern in recent years because of its detrimental effect upon television and radio reception and upon electronic navigational equipment. The problem has been accentuated by the increasing number of such engines and by the increasing use of electronic equipment sensitive to their interference.

2. Description of the Prior Art

It is well known that EMI caused by the operation of an internal combustion engine can be reduced by the insertion of a resistance element in the high voltage ignition circuit for each spark plug of the engine. Resistance elements can be placed either in the bore of the spark plug insulator, in series with the center electrode, or at some other location in the ignition system, for example in the distributor rotor or in the high-voltage ignition cables. A common practice is to insert a semiconducting ceramic or a carbon or a wire-wound resistor in the bore of a spark plug insulator between the terminal of the plug and its center electrode.

Ceramics having high dielectric constants are well-known for use in capacitors. However, so far as is known, the art does not suggest a spark plug for an internal combustion engine which has an insulator made from a ceramic having a high-dielectric constant for the purpose of suppressing EMI.

SUMMARY OF THE INVENTION

The instant invention is based upon the discovery of an improved spark plug which suppresses EMI caused by an internal combustion engine. The spark plug of the invention reduces the need for resistance or other suppression elements in the high-voltage ignition circuits of the engine. The particular, the spark plug of the present invention is one wherein a high-dielectric ceramic material comprises at least a portion of its insulator, and wherein the high-dielectric material and other parts of the plug are so disposed and related that the capacitance of the plug is effective to suppress EMI.

A conventional spark plug for an internal combustion engine comprises a shell releasably engageable with the engine, an insulator mounted in the shell, a center electrode seated within the insulator, and a ground electrode structurally integral with the shell and in spark gap relationship with the center electrode. At least a portion of the insulator of an improved spark plug according to the instant invention, between the center electrode and the shell, has a dielectric constant sufficiently high that the effective dielectric constant of the insulator is at least 30. In addition, the relationships among the elements of a spark plug of the invention and the effective dielectric constant of the insulator are such that the spark plug has a capacitance of at least 20 picofarads. EMI from such spark plugs having a capacitance of 40 picofarads has been measured in comparison with that from unsuppressed plugs; substantial suppression of EMI was observed for the 40 picofarad plugs at frequencies ranging from zero to 1000 megahertz.

In a preferred embodiment, a spark plug according to the invention has an insulator of one-piece construction, which consists essentially of a high-dielectric ceramic material. Such an insulator, however, can be of segmented construction, comprising one or more high-dielectric ceramic segments mounted adjacent to other ceramic insulating materials being composed of, for example, predominantly alumina. Preferably, a spark plug according to the invention has a capacitance of from 20 to 100 picofarads, and, most desirably, a capacitance of from 30 to 80 picofarads.

Accordingly, it is an object of the instant invention to provide a spark plug for an internal combustion engine.

It is a further object to provide an improved spark plug including an insulator having a relatively high effective dielectric constant, and wherein the relationships among the elements of the spark plug and the effective value of the dielectric constant of the insulator are such that the plug has a capacitance which enables it to suppress EMI.

Other objects and advantages of the invention will be apparent from the description which follows, reference being made to the accompanying drawings.

DETAILED DESCRIPTION OF THE INVENTION

Figure 1:
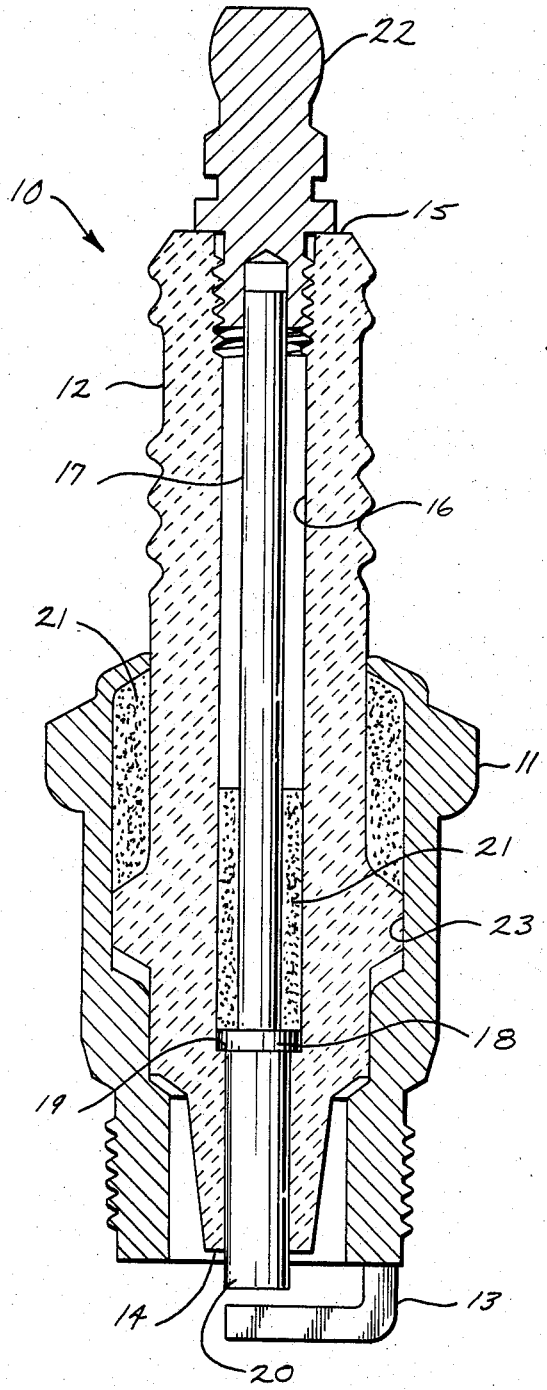
FIG. 1 is a view in longitudinal cross-section of a spark plug according to the instant invention.

Referring in more detail to the drawings, and in particular to FIG. 1, a spark plug according to the invention is indicated generally at 10. The spark plug 10 comprises a threaded shell 11, a longitudinally-extending insulator 12 carried by the shell 11 and a ground electrode 13 structurally integral with the shell 11. The insulator 12 has a firing end 14, a terminal end 15 and a stepped bore 16 extending therethrough. The insulator 12 comprises barium titanate, a ceramic material having a high dielectric constant. A center electrode 17 having a head 18 seated on a shoulder 19 of the stepped bore 16 has, adjacent to the firing end 14 of the insulator 12, a firing tip 20 in spark gap relationship with the ground electrode 13. In service, the threaded shell 11 is releasably engaged with and electrically grounded to an associated internal combustion engine (not shown); the ground electrode 13 and the firing tip 20 of the center electrode 17 are positioned within a combustion chamber of the engine. Talc sealing material 21 is disposed in the bore 16 between the center electrode 17 and the insulator 12, and between the shell 11 and the insulator 12.

The terminal end 15 of the insulator 12 is threadably engaged with an electric terminal 22 which makes an electrical connection with the center electrode 17. In service, when electric voltage from an ignition system (not shown) of an associated engine is applied to the terminal 22, sparking occurs across the spark gap between the firing tip 20 of the center electrode 17 and the ground electrode 13, thereby igniting an air/fuel mixture in the combustion chamber. In addition, a portion of the insulator 12 is in contact with the shell 11 along an annular surface 23 thereof. Accordingly, in service, there is a dielectric path from the center electrode 17, through the insulator 12, the surface 23 and the shell 11 to the associated engine.

Figure 2:
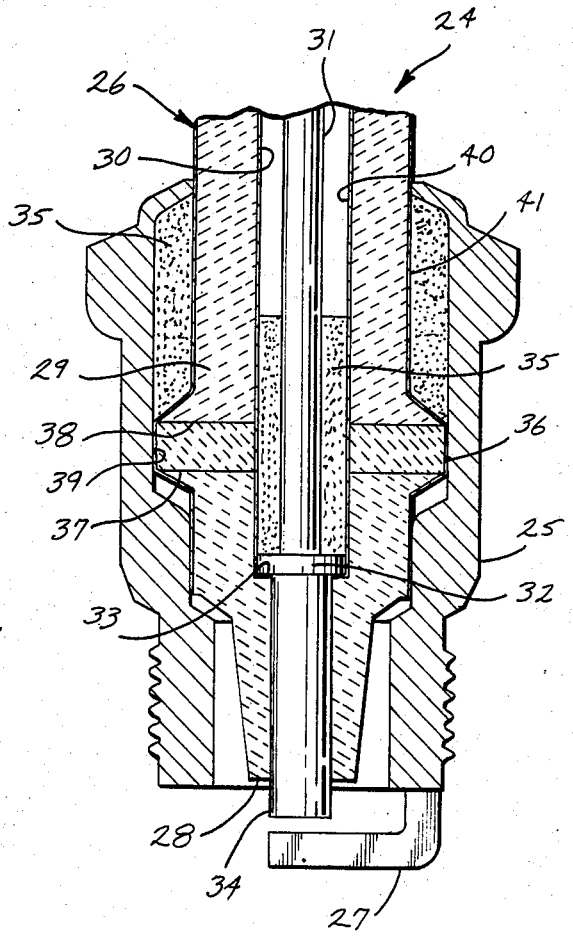
FIG. 2 is a fragmentary view in longitudinal cross-section of another spark plug according to the invention.

Referring now in more detail in FIG. 2, another spark plug according to the invention is indicated generally at 24, only a firing end portion thereof being shown. The spark plug 24 has a shell 25 threaded for releasably engaging the cylinder head of an associated internal combustion engine (not shown), an insulator 26 carried by the shell 25 and a ground electrode 27 structurally integral with the shell 25. The insulator 26 has a firing end segment 28, a terminal end segment 29 and a stepped bore 30 extending therethrough. The spark plug 24 further comprises a center electrode 31 having a head 32 seated on a shoulder 33 of the bore 30. The electrode 31 has a firing tip 34 in spark gap relationship with the ground electrode 27; in service, the electrode 27 and the firing tip 34 of the center electrode 31 are positioned within a combustion chamber of the engine (not shown). Talc sealing material 35 is disposed between the insulator 26 and the bore 30, and between the shell 25 and the insulator 26.

The insulator 26 also has a cylindrical center segment 36 disposed within the shell 25; the segment 36 is located between the firing end segment 28 and the terminal end segment 29, and is bonded thereto at substantially planar interfaces indicated at 37 and 38. The segments 28 and 29 of the insulator 26 consist essentially of alumina, whereas the center segment 36 comprises a barium titanate ceramic composition having a high dielectric constant. The segment 36 is in contact with the shell 25 along an interior annular surface 39, so that there is a dielectric path from the headed end 32 of the center electrode 31, through the segment 28 of the insulator 26, the interface 37, the segment 36 and the surface 39 to the shell 25. There is a layer 40 of silver paint in part of the bore 30 of the insulator 26; there is a layer 41 of silver paint on the portion of the exterior of the insulator 26 which is immediately adjacent to the shell 25.

The present invention will be more fully understood from the following Examples, which describe improved spark plugs according thereto. The Examples are intended only to illustrate and disclose and in no way to limit the invention as defined in the claims appended hereto.

EXAMPLE I

The spark plug 10, FIG. 1, was produced as described below. The shell 11 was formed by conventional metal working techniques from a nickel alloy. Nickel alloy wire, having a diameter of 0.125 inch, was headed and welded to conventional, complementary electrode parts to form the center electrode 17 with the headed end 18 and firing end 20. The ground electrode 13 was fabricated from nickel alloy bar stock. A piece 0.072 inch by 0.125 inch was cut from the stock, bent to the shape shown in FIG. 1 and welded to the shell 11 as shown. The spark gap between the tip 20 and the electrode 17 was adjusted to 0.030 inch, using conventional gapping equipment.

The insulator 12 was produced from a ceramic batch composed of 3780 g. of barium titanate, 160 g. of EPK (Kaolin), 60 g. of bentonite clay, 1900 g. of water and 19 g. of "Marasperse", a dispersing agent. The specific barium titanate used is available commercially from N. L. Industries, Inc., under the designation "Tamtron 5037"; it is reported to have a dielectric constant of from about 20 to 1600, depending largely upon the temperature and atmosphere under which it is fired. The EPK Kaolin and the bentonite clay were added as fluxes to aid in subsequent firing. The foregoing ingredients were mixed together for about one hour; near the end of this period a substantially uniform slurry was observed to form. Paraffin, in an amount of about 4.0 percent by weight of the slurry (to serve as a binder during subsequent processing), and trihydroxyethylamine stearate, approximately 0.4 percent by weight of the slurry (to function as an emulsifying agent for the paraffin), were then added to the batch while mixing was continued. The mixture which resulted was then spray-dried, temperature about 350° F., in a conventional atomizer-type spray drier; the powder thereby produced was observed to comprise spherical particles about 200 micrometers in diameter. The powder was charged to a right circular cylindrical cavity of a conventional isostatic press and pressed, pressure about 5000 psi, around a stepped mandrel into a longitudinally-extending billet. The billet was then turned on a lathe to the shape, before shrinkage, of the insulator 12 shown in FIG. 1. The shaped, green insulator body was then fired in air, in a conventional convection furnace; the temperature of the furnace was raised linearly, over a period of about four hours, from room temperature (about 70° F.) to approximately 2520° F. When the maximum temperature was reached, the power to the furnace was turned off and the body was allowed to cool to room temperature in the furnace. The fired ceramic spark plug insulator 12 which resulted was found to have an effective dielectric constant K of about 40, by calculation from Equation I:

$$K = \frac{C(\ln r_2 - \ln r_1)}{2\pi\, \epsilon_o\, h}$$

where:

K is the dielectric constant to be calculated

C is the measured capacitance of the assembly $r_1$ and $r_2$ are the inside and outside radii for high dielectric cylindrical portion of the insulator $\epsilon_o$ is the permittivity of free space known to be $8.85\times10^{-12}$ *coulomb*$^2$/n. met$^2$, and h is the height of the high dielectric cylindrical section.

The spark plug 10 of FIG. 1 was produced from the insulator 12 and the conventional spark plug elements described above. Conventional spark plug assembly techniques were used. The capacitance of the spark plug 10 so produced was found by measurement to be about 40 picofarads.

EXAMPLE II

A conventional, green ceramic insulator body, consisting essentially of alumina and having substantially the overall configuration of the insulator 12 of FIG. 1, was produced by the conventional steps of milling ceramic batch, spray-drying the batch, pressing a billet around a mandrel and turning the billet to form the green body. The body so produced was approximately 2.3 inches in length. The insulator body was fired to maturity and an insulator terminal end was then cut from the alumina body, perpendicular to its longitudinal axis, approximately 1.9 inches from the tip of the firing end. The insulator firing end was similarly cut approximately 1.6 inches from the tip of the firing end. The segment of the body between the cuts was then removed. Another green ceramic body was prepared having a center bore and an overall shape substantially identical to the removed body segment but composed of the barium titanate material described in Example I. The barium titanate material was fired in air, maximum temperature approximately 2570 degrees F., and cooled to room temperature in the furnace as described in Example I. The insulator terminal end, insulator firing end, and the barium titanate body were then glass-bonded to one another to produce the insulator 26 (FIG. 2).

The layers 40 and 41 of silver paint were then applied to the insulator 26 and the spark plug 24 was produced generally as described above. The spark gap between the tip 34 of the electrode 31 and the ground electrode 27 was adjusted to 0.015 inch.

The capacitance of the spark plug 24 was found to be approximately 50 picofarads. The effective dielectric constant, K, of the insulator 27 was about 110, calculated from Equation I, above.

Spark plugs were produced according to the procedures described in the foregoing examples, which had capacitances of about 40, 800, and 1420 picofarads. By comparison, a conventional spark plug, of substantially the same overall construction and appearance as the plug 10 shown in FIG. 1, but which had been previously assembled by using conventional procedures and a one-piece, alumina insulator, was found to have a capacitance of 10 picofarads. This value of capacitance is the base line in the context of the instant invention. These plugs were fired at atmospheric pressure by a bench-mounted inductive ignition system connected to a test fixture in which the plugs were mounted. An antenna, positioned near the test fixture, was connected to an oscilloscope so that EMI received by the antenna during testing could be observed on the oscilloscope screen. The frequency range of 0 to 1000 megahertz was scanned on the oscilloscope. The EMI observed during sparking of the 10 picofarad plug with the particular ignition system, was used as a standard, or base line. Significantly less than the standard or base line EMI was observed, throughout the 0 to 1000 megahertz range, during sparking of the 40 picofarad plug. The 800 picofarad plug did not spark well with the particular ignition system; there appeared to be an electrical discharge through the insulator, possibly due to an electrical breakdown thereof. The 1420 picofarad plug did not spark on the equipment used in the test, possibly because of the inability of the particular ignition system to charge the spark plug to a voltage high enough to ionize the gap.

Figure 3:
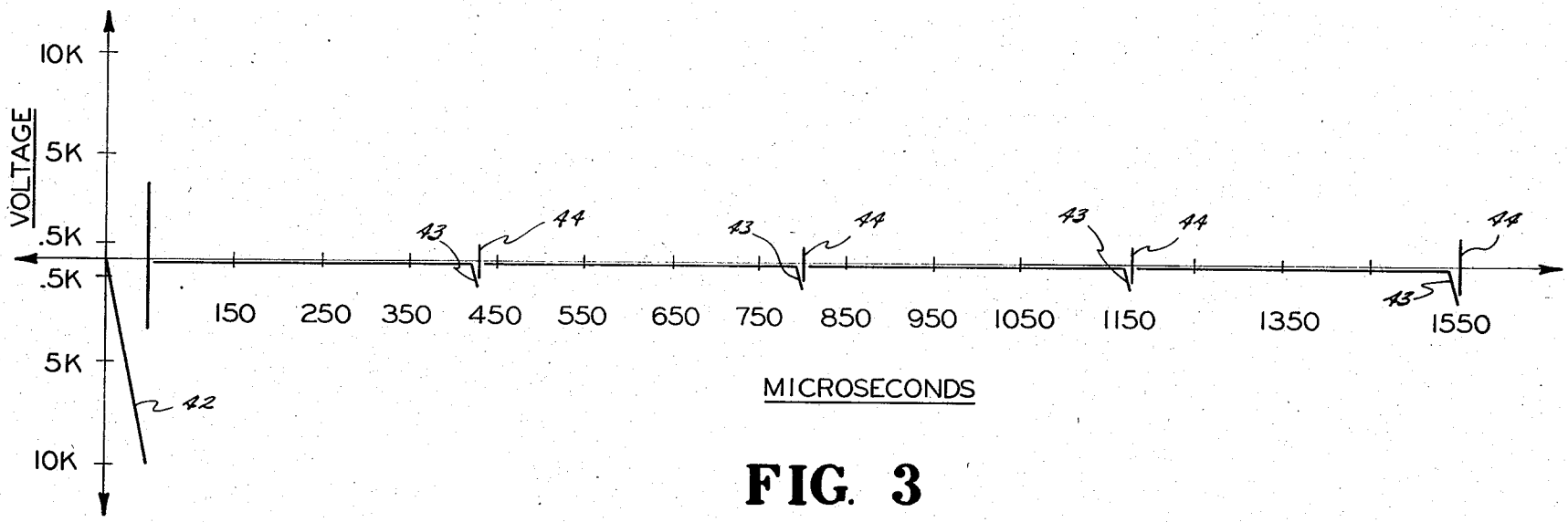
FIG. 3 is a graph showing the changes in voltage potential of a center electrode of a conventional spark plug during and after a voltage rise in an ignition system electrically connected thereto.

With reference to FIG. 3, as a conventional inductive ignition system applies a voltage (negative, in present day systems) to a center electrode of a spark plug, the electrode is charged negatively as indicated at 42. When the potential reaches, for example, minus 10,000 volts, an initial spark discharge occurs. Typically, as shown in FIG. 3, (1) It takes approximately 50 microseconds for an inductive ignition system to charge a center electrode to minus 10,000 volts,
(2) Following the initial spark discharge, the electrode is recharged several times to about minus 500 volts as indicated at 43 and discharged by trailing spark discharges as indicated at 44, and
(3) The last of the trailing spark discharges occurs about 1500 microseconds after the initial spark discharge.

Figure 5:
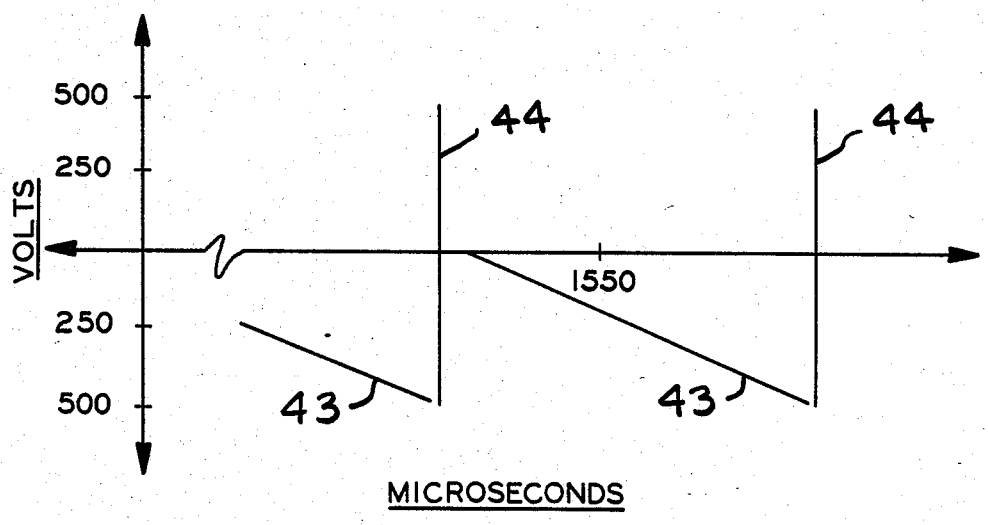
FIG. 5 is an enlargement of a portion of the graph shown in FIG. 3.

FIG. 5 is a greatly enlarged view of a portion of the FIG. 3 graph showing the part thereof in the vicinity of 1550 microseconds and the recharging indicated at 43 and the trailing spark discharge indicated at 44 which occur in that region. What is shown in FIG. 3, at 1500 microseconds, as one recharging indicated at 43 and one trailing discharge indicated at 44, actually involves, as shown in FIG. 5, a plurality of rechargings indicated at 43 and trailing discharges indicated at 44. Typically, each of the rechargings indicated at 43 and discharges indicated at 44 occurs in a few nanoseconds. By comparison with the rate at which the electrode is recharged, as indicated at 43, the rate at which it is charged initially, as indicated at 42, is extremely low.

Figure 4:
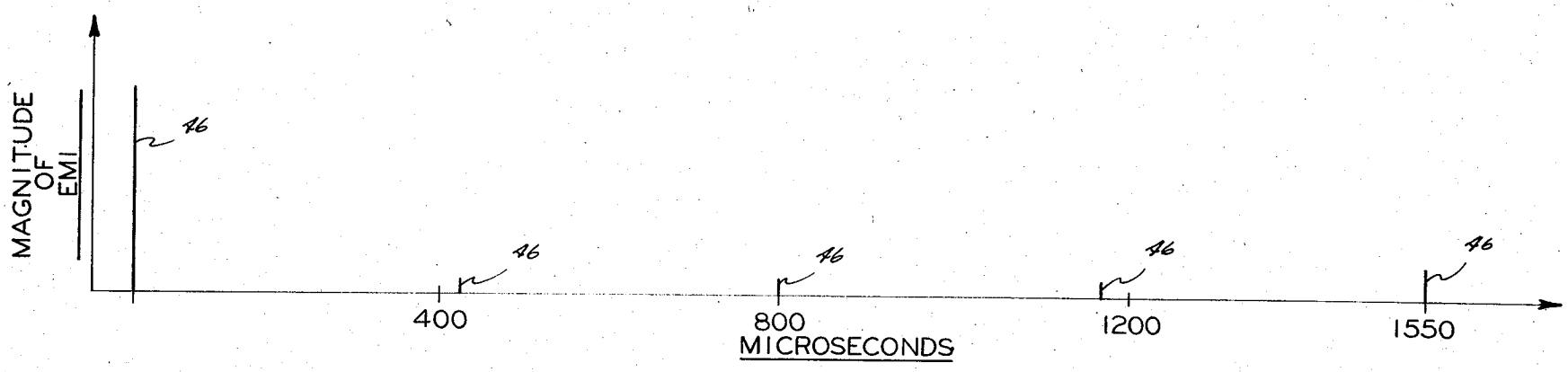
FIG. 4 is a graph showing the magnitude of EMI, independent of its frequency, which accompanies the changes in voltage potential shown in FIG. 3.

Both the initial spark discharge and the subsequent trailing spark discharges cause EMI, as indicated at 46 (FIG. 4). This representation of EMI in FIG. 4 does not show variations as a function of frequency.

The ability of a spark plug of the instant invention to suppress EMI may be explained in terms of its characteristics as a capacitor. The shell and the center electrode may be thought of as the capacitor plates, separated by the insulator, which is a dielectric. The spark gap may be thought of as a second dielectric which comprises air. The capacitive reactance ($R_c$) of the plug, i.e., the opposition to the flow of alternating current across its insulator, can be calculated from Equation II:

$$R_c = \frac{1}{2\pi fC}$$

where:

f=Frequency of the alternating current and

C=Capacitance of the spark plug.

It is apparent from Equation II that the capacitive reactance of a spark plug varies as an inverse function of its capacitance and as an inverse function of the frequency of the radiation or alternating current involved. Moreover, the capacitance of a spark plug is a direct function of the dielectric constant of the material between the electrodes of the plug (see Equation I). The potential associated with an increasing or decreasing voltage behaves like an alternating current with respect to Equation II. The frequency of such current is a direct function of the rate of the increase or decrease in the voltage.

For spark discharge to occur between a center electrode of a spark plug and a ground electrode, the associated ignition system must charge the spark plug to a voltage sufficiently high to ionize the spark gap. If the dielectric constant of the spark plug insulator is high, the capacitance of the spark plug will be large and the capacitive reactance will be comparatively low with respect to a charging voltage applied to the center electrode by an ignition system (although even lower with respect to the extremely high frequency recharging voltage, see FIG. 5). This suggests that there is a value of spark plug capacitance at which the energy applied to the spark plug by an ignition system can leak through the insulator to the shell thereby preventing the center electrode from being charged to a voltage sufficiently high to ionize the gap. This problem can be alleviated in several ways, including:

(1) shortening the spark gap, thereby reducing the voltage to which the center electrode must be charged to ionize the gap,
(2) independently ionizing the gap to cause spark discharge at the voltage to which the center electrode has been charged,
(3) reducing the rate at which the ignition system charges the center electrode, thereby reducing the frequency of the energy applied to the spark plug so that the capacitive reactance of the spark plug with respect to that energy will be higher and the leakage will be reduced.

The amount of energy which a spark plug can store is a direct function of its capacitance. Accordingly, a high capacitance spark plug can store a large amount of energy and, even if the leakage of energy applied thereto is controlled, such a spark plug may store all of the energy available from a given ignition system at a potential which is insufficient to ionize the gap. This problem can be remedied by one of several expedients including:

(1) shortening the spark gap, thereby reducing the voltage to which the center electrode must be charged to ionize the gap,
(2) independently ionizing the gap to cause spark discharge at the voltage to which the center electrode has been charged,
(3) increasing the amount of energy which is delivered by the ignition system to the spark plug thereby increasing the voltage available to ionize the gap.

An insulator of a spark plug, like a spark gap, is subject to electrical break-down from high voltage. The voltage at which an insulator will break down is a direct function of its dielectric strength. If the break-down voltage of the insulator is lower than the break-down voltage of the gap, the energy applied to the spark plug will discharge through the insulator. This phenomenon, which was observed in the 800 picofarad spark plug described above, can be avoided by shortening the spark gap to an extent such that the break-down voltage thereof is lower than the breakdown voltage of the insulator.

As suggested previously, the capacitive reactance of a given spark plug will be higher with respect to a charging voltage than with respect to a recharging voltage because the latter has a higher frequency. If the capacitive reactance of a plug with respect to recharging voltages is such that they leak to ground through the insulator, the trailing spark discharges and the resultant EMI would be curtailed or even eliminated. A spark plug of the instant invention, according to this theoretical explanation, is one having sufficient capacitance so that it stores the charging voltage delivered by an ignition system, but through which the higher frequency recharging voltages leaks to ground.

This phenomenon is believed to be responsible for the ability of a spark plug of the instant invention to suppress EMI. This theoretical explanation correlates with observations during the above-described testing that the 40 picofarad spark plug of the invention, by comparison with the conventional 10 picofarad spark plug, effected substantial EMI suppression.

While only two embodiments of the invention have been described in connection with the attached drawings, it will be appreciated that spark plugs according to the invention can also be produced which have insulators similar to the insulators 12, and 26 shown in FIGS. 1, and 2, but which comprise, for example, multiple segments of high dielectric ceramic materials bonded to segments of alumina or other ceramics having lower dielectric constants. Insulators of spark plugs according to the invention can be of any convenient or desired shape or construction, so long as the effective dielectric constant of the entire insulator is at least 30 and the capacitance of the assembled spark plug is at least 20 picofarads.

It will be appreciated that any suitable high-dielectric material can be used in an insulator of a spark plug of the invention, in place of the barium titanate composition described in the foregoing Examples, so long as the effective dielectric constant of the finished insulator is at least 30. For example, any perovskite having a suitably high-dielectric constant can be used, as can mixtures of barium titanate with such perovskites.

The dimensions, in a spark plug of the invention, of the insulator, and such factors as the geometry, proportions, composition and arrangement of other elements are not critical, so long as the assembled plug has a capacitance of at least 20 picofarads. For instance, although Example II describes a spark plug according to the invention having silver-coated insulator surfaces, silvering is not critical to the ability of the plug to suppress EMI. However, silvering is preferable, as in the case of conventional spark plugs, to assure good electrical contact between the electrodes and surfaces of the insulator; in addition, silvering is desirable because it somewhat increases effective electrode plate size. It is, therefore, to be appreciated that numerous structural modifications, in addition to those specifically described above, are possible within the scope of the present invention.

Although preferred embodiments of the invention have been described, it is to be understood that the scope of the invention is not limited thereto or thereby. It will be apparent that various changes and modifications can be made from the specific disclosure hereof without departing from the spirit and scope of the invention as defined in the following claims.

What we claim is:

1. In a spark plug comprising a shell releasably engageable with an internal combustion engine, an insulator mounted in said shell, a center electrode seated within the insulator, and a ground electrode structurally integral with the shell and in spark gap relationship with the center electrode, the improvement wherein at least a portion of the insulator disposed between the center electrode and the shell has a dielectric constant sufficiently high that the effective dielectric constant of the insulator is at least 30, and wherein the relationships among the elements of the spark plug and the effective value of the dielectric constant of the insulator are such that the spark plug has a capacitance of at least 20 picofarads.

2. The improvement claimed in claim 1, wherein the insulator comprises a high dielectric ceramic body.

3. The improvement claimed in claim 1, wherein the insulator comprises a segment of a high dielectric ceramic body adjacent an alumina body.

4. The improvement claimed in claim 1 wherein the average dielectric constant of the insulator is such that the spark plug has a capacitance of from 20 to 100 picofarads.

5. The improvement claimed in claim 3 wherein the average dielectric constant of the insulator is such that the spark plug has a capacitance of from 20 to 100 picofarads.

6. The improvement cliamed in claim 2 wherein the average dielectric constant of the insulator is such that the spark plug has a capacitance of from 20 to 100 picofarads.

7. The improvement claimed in claim 1 wherein the average dielectric constant of the insulator is such that the spark plug has a capacitance of from 30 to 80 picofarads.

8. The improvement claimed in claim 3 wherein the average dielectric constant of the insulator is such that the spark plug has a capacitance of from 30 to 80 picofarads.

9. The improvement claimed in claim 2 wherein the average dielectric constant of the insulator is such that the spark plug has a capacitance of from 30 to 80 picofarads.

* * * * *